United States Patent [19]

Boser

[11] Patent Number: 4,799,441

[45] Date of Patent: Jan. 24, 1989

[54] METHOD OF SEWING ELASTIC ABOUT A GARMENT OPENING

[76] Inventor: Ronald J. Boser, 711-3 Koehler Ave., Ronkonkoma, N.Y. 11779

[21] Appl. No.: 215,333

[22] Filed: Jul. 5, 1988

[51] Int. Cl.[4] ..... D05B 97/00; A41D 1/06

[52] U.S. Cl. ..... 112/262.2; 112/265.1; 112/418; 2/237; 2/403; 2/406

[58] Field of Search ..... 112/262.2, 265.1, 121.26, 112/121.27, 104, 418, 406; 2/237, 221, 403, 406

[56] References Cited

U.S. PATENT DOCUMENTS 4,048,277 9/1977 Breznar ..... 112/406

4,682,556 7/1987 Bleck ..... 112/265.1

4,703,706 11/1987 Plante ..... 112/265.1

*Primary Examiner*—H. Hampton Hunter

*Attorney, Agent, or Firm*—Myron Amer

[57] ABSTRACT

A method of sewing a length of elastic about a garment waist opening in which after the leading end is sewn initially below and then raised to the level of and sewn for most of its length about the garment waist opening, the unattached trailing end is shifted also below the garment waist opening and sewn to the garment, so that both elastic ends, which may exhibit fraying and otherwise be unsightly, are significantly out of sight in their location below the garment waist opening.

3 Claims, 2 Drawing Sheets

METHOD OF SEWING ELASTIC ABOUT A GARMENT OPENING

The present invention relates generally to a method of sewing elastic, tape or the like about a garment leg or waist opening, in which the leading and trailing length segments of the elastic must necessarily overlap, and more particularly relates to improvements in a sewing method for obviating in the overlap of the elastic leading and trailing ends any unnecessary bulk which causes discomfort to the wearer, or any fraying in the elastic ends which contributes to unsightliness in the garment appearance.

The sewing of a die cut appropriately shaped pattern in the flat into a women's panty illustrates two prior art sewing methods that attempt to deal with the sewing attachment of the leading and trailing ends of the elastic about a garment leg or waist opening. In one method, one of the garment side seams is left unsewn until after the elastic is applied about the opening (leg or waist), so that the opposite elastic ends can be made to coincide with the side seam and thereby be caught in this side seam. This has the shortcoming that the sewing of the side seam is the last sewing operation, when it is desirable that the sewing of the elastic about the garment opening be the last sewing operation and, in any event, the side seam with the ends of the elastic invariably produce bulk which is uncomfortable to the wearer.

In the other prior art sewing method, the elastic is placed last about the garment opening and thus covers over both garment side closure seams and, of course, cannot have its opposite ends caught in a seam. Instead, the opposite ends are typically merely overlapped and caught in the zig-zag or other stitching which attaches the elastic to the garment. The trailing end of the elastic is, of course, cut from a supply spool thereof, and this end, particularly if finished with a picot along one edge, will invariably fray dispite the zig-zag stitching, and thus detract from the appearance of the garment.

It is an object of the present invention to overcome the foregoing and other shortcomings of the prior art. More particularly, it is an object to have the sewing advantages of applying the elastic as the last sewing operation, and in place of the function of the prior art side seam, instead use a folded down configuration in the elastic trailing end and an out-of-the way location thereof, to obviate the problem of fraying or in otherwise contributing to an unsightly appearance in the finished garment.

The description of the invention which follows, together with the accompanying drawings should not be construed as limiting the invention to the example shown and described, because those skilled in the art to which this invention appertains will be able to devise other forms thereof within the ambit of the appended claims.

In the drawings, prior art sewing methods as exemplified by FIGS. 1–7 are contrasted with the within inventive sewing method herein described in conjunction with FIGS. 8–13. In this regard:

In explaining the within inventive sewing method, it is helpful to first explain the prior art sewing method which it replaces, so that the noteworthy differences therebetween can be better appreciated. This prior art sewing method actually has two variations, both of which will now be explained in connection with the die cut women's panty pattern 10 shown in plan in FIG. 1, and sewn into a panty in either one of the two forms respectively illustrated in the perspective views FIGS. 2 and 5.

Figure 1:
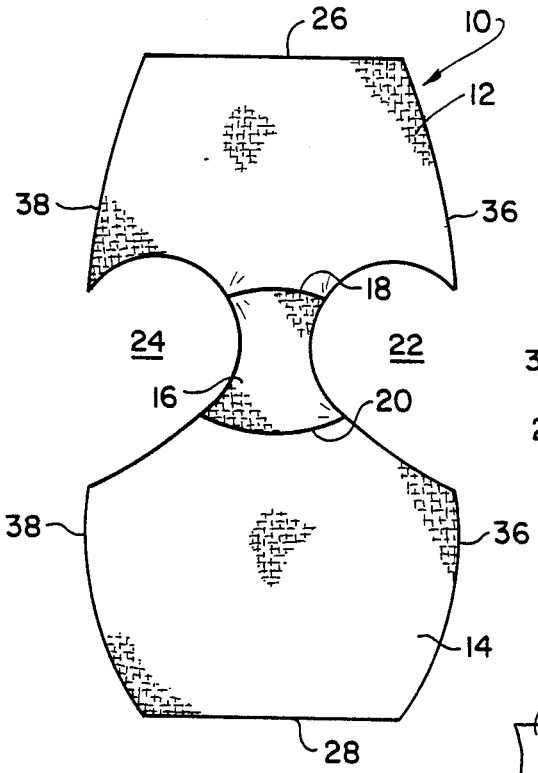
FIG.1 PRIOR ART
FIG. 1 shows a basic pattern for fabric panels of a women's panty before final sewing.

For orientation purposes, FIG. 1 shows the inside surface of the material. Pattern 10 has a front panel 12, a rear panel 14 and is joined by a crotch patch panel 16 at seams 18 and 20. The cut of pattern 10 allows for the right leg opening 22 and for left leg opening 24. Edges 26 and 28 comprise the waist opening 30 and edges 36 and 38 will subsequently form right and left vertical seams 36' and 38' respectively.

Figure 2:
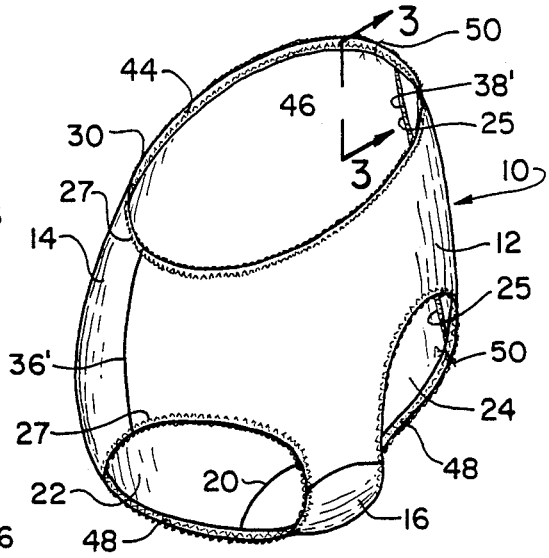
FIG.2 PRIOR ART
FIG. 2 is a perspective view of one form of sewn
Figure 5:
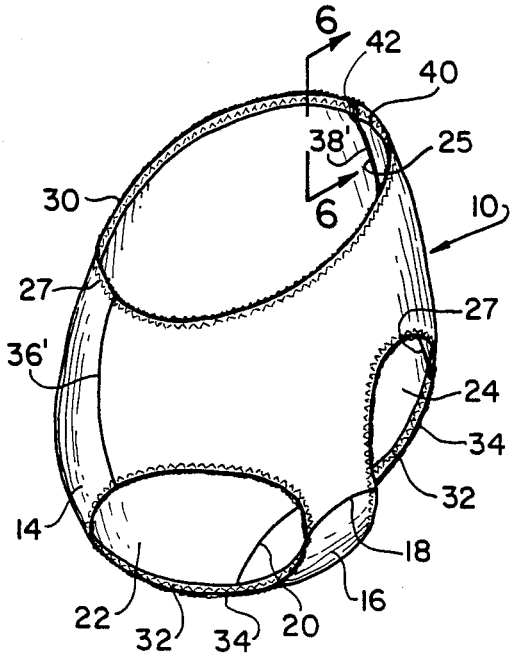
FIG.5 PRIOR ART
FIG. 5 is a perspective view similar to FIG. 2, but of a second form of sewn panty.

As a die cut pattern in the flat pattern 10 is adaptable to either of the prior art embodiments shown in FIGS. 2 and 5, or to the inventive embodiment. That is in all three embodiments, the main concern is to form right and left vertical side seams using a so-called serging stitch 25 and to attach elastic tape to the waist and leg openings of the pantry using a conventionally used so as not to impede the stretch of the elastic when it is joined to the fabric. Of particular concern, is the attachment of elastic tape with decorative picot along an edge in an efficient, attractive manner with a minimum of lumping and fraying at the finish joint. In this connection, all elastic bands can be precut to size or fed from a stock roll and cut at or near the finish joint by manual or semi-automatic scissor means (not shown), but with all known prior art sewing methods there is either uncomfortable lumping or unsightly fraying in the elastic at the finish joint, whereas these conditions are effectively obviated by the inventive sewing method.

PRIOR ART SEWING METHODS

Figure 6:
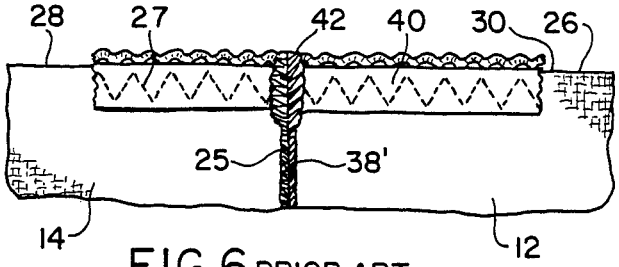
FIG.6 PRIOR ART
FIG. 6 is a partial view, in section taken along line 6—6 of FIG. 5.
Figure 7:
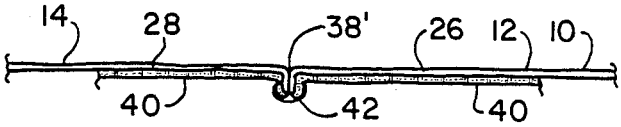
FIG.7 PRIOR ART
FIG. 7 is a plan view of FIG. 6.

In FIGS. 5, 6, and 7 a first prior art sequence of assembling a panty beyond the pattern 10 of FIG. 1 is shown. As an initial step, elastic 32 with picot 34 is sewn about both leg openings of pattern 10. Edges 36 of the front and rear panels are then brought together and sewn with stitch 25 to form a right vertical seam 36' which catches the ends of elastic tape 32 in seam 36. At this point left vertical seam 38' is still unsewn. Elastic tape 40 can now be sewn to waist opening 30 beginning at edge 38 of panel 12 along the edge 26 thereof, and is sewn over the upper end of completed right vertical seam 36', and along edge 28 of panel 14 and is then adapted to finish at edge 38 of panel 14. With the garment inside out, the left vertical seam 38' can now be sewn from either the top or bottom and made to include a lower finish joint consisting of elastic tape 34 of leg opening 24 and an upper finish joint of waist elastic 40. As seen in FIGS. 6 and 7, this finish joint designated 42 includes layers of material from both front and rear panels 12 and 14 along with two thicknesses of elastic tape 40 bunched together within serging stitch 25. Joint 42 is typical of the finished joint that developes in both right and left leg openings 22 and 24, which are respectively coincident with the right and left vertical seams 36' and 38'.

Obviously, this elastic finishing routine as above described, requires much handling between the various operations and produces a joint that is bulky and uncomfortable for the wearer.

Figure 3:
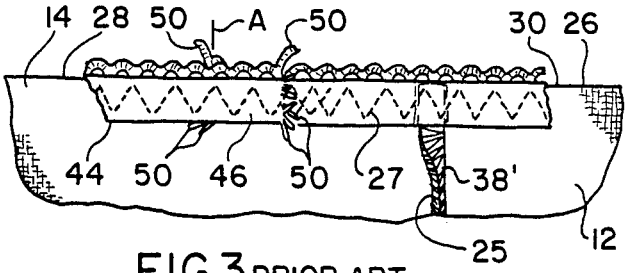
FIG.3 PRIOR ART
FIG. 3 is a partial view in section taken along line 3—3 of FIG. 2.
Figure 4:
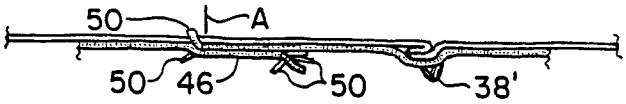
FIG.4 PRIOR ART
FIG. 4 is a plan view of FIG. 3.

Another popularly used sewing method to attempt efficient assembly of an attractive and comfortable garment is illustrated in FIGS. 2, 3, and 4. Starting with pattern 10, the operator uses the serging stitch 25 to form right and left vertical seams 36' and 38'. This sewing is done so that the seams 36' and 38' end up within the finished garment. At this point the panty is complete except for the addition of the elastic.

Full circle sewing, well known in the industry, is employed to finish waist opening 30, right leg opening 22 and left leg opening 24. Typically, this technique, when used on waist opening 30 (as shown in FIGS. 2, 3, and 4) utilizes conventional zig-zag stitching 27 to hold the leading end of elastic tape 44 at any point A along the perimeter of opening 30. As its name implies, stitching is continued about the opening until the trailing end of tape 44 overlaps the leading end by a few stitches, as at 46. In like fashion, additional elastic tape is sewn to leg openings 22 and 24, and the panty of FIG. 2 is then completed.

While the procedure as just described minimizes handling and increases operator efficiency to a large extent, a shortcoming inherentin this manufacturing method is the problem of fraying as shown at 50. That is, the leading ends, and more so the trailing ends of elastic tapes 44 and 48, have a tendency to yield to unsightly fraying, especially after many washings and wearings.

THE INVENTIVE SEWING METHOD

Figure 13:
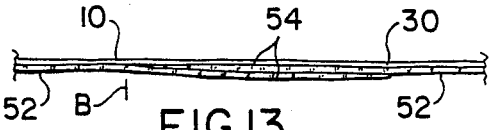
FIG. 13 is a plan view similar to FIGS. 4 and 7 and taken in section along line 13—13 of FIG. 12.
Figure 11:
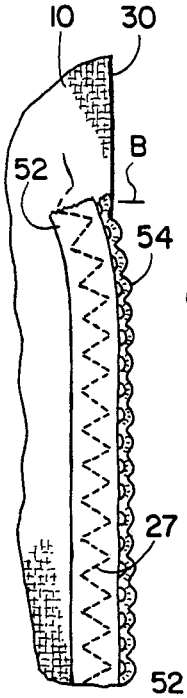
FIG. 11 is a view similar to FIGS. 3 and 6 in so far as showing the starting of the elastic attachment to the illustrated panty.
Figure 12:
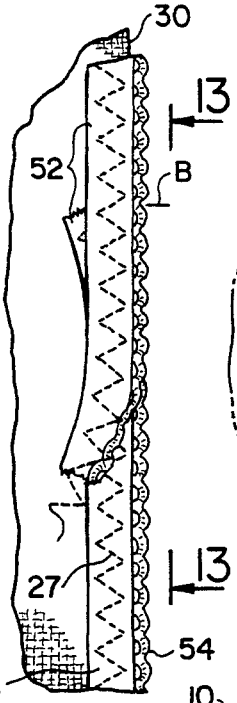
FIG. 12 is a view similar to FIG. 11 but showing the of the elastic attachment to the panty.

Details of the inventive embodiment of the elastic tape finishing are shown in FIGS. 11, 12 and 13. The aim of this embodiment is to retain the manufacturing advantages of full circle sewing and to overcome the inherent disadvantages of fraying and bulky elastic tape finish joints.

As in the previous prior art embodiment, vertical seams 36' and 38' are sewn onto pattern 10 as a preliminary to elastic tape finishing. FIG. 11 shows the lead end of elastic tape 52 at point B stitched below the plane of waist opening 30 and immediately thereafter sewn into position with the picot 54 in its normal position above the plane of the opening 30. Optionally the leading end of picot 54 can be folded over (or under) tape 52 to be caught in the zig-zag stitch 27 or left flat (as shown) to be covered eventually by the trailing end of elastic tape 52, and thus the appearance of the leading end of picot 54 at point B is of little consequence. As in the sewing of the FIG. 2 panty, full circle sewing is continued along the perimeter of waist opening 30 and includes the crossing of the upper ends of seams 36' and 38'. As the sewing of tape 52 passes point B, the present invention contemplates that the operator manipulate pattern 10 to bring tape 52 below the plane of waist opening 30 and at the same time that the operator trigger attachment 56 (FIG. 8) to cause picot 54 to fold either over or under and against elastic tape 52, so that the trailing end of the picot 54 is caught in the zig-zag stitch 27.

A like procedure is used to attach similar elastic tape 52 with picot 54 to leg openings 22 and 24. At the crossover point (See FIG. 13) there thus results a smooth non-bulky finish joint with minimum fraying possibilities. Any fraying that does occur will be well below the plane of waist opening 30 thereby contributing to an elastic tape finish joint that is practically imperceptable from the outside and comfortable to the wearer.

To implement the sewing of the finish joint of FIGS. 11 and 12, which is characterized first by the leading and trailing length segments of the elastic and picot 52, 54 being in overlapping relation, second by this overlap occurring below the plane of the opening 30, and third by the trailing end of elastic and picot 52, 54 being caught in the zig-zag stitching 27, there is manual manipulation, well within the sewing skills of a seamstress required, and also the use of a picot-folding device, which in a preferred embodiment is constructed and operates in the manner of attachment 56, now to be described.

Attachment 56 is adjustably mounted on a conventional sewing machine 58 by screws 60 which engage tapped holes in the machine bed plate 62. Base member 64 of attachment 56 supports a cantilever arm 66 having reversely bent or return member 68. Clearance under arm 66 allows for seamstress manipulation of the fabric of pattern 10. The right side face of member 68 serves as a guide for tape 52. Member 68 is sandwiched between the upper and lower arms of a bifurcated slide member 70. Slide member 70 is urged through movement towards the stationary return member 68 by means 72, which can be an air cylinder, solenoid or hand lever. Although not shown, the powering means 72 includes appropriate means to limit the sidewise stroke of slide member 70. The slot 74 that is cut within slide 70 is finished at a convergent angle towards the sewing machine presser foot 76 and radiused at its base 78.

Figure 8:
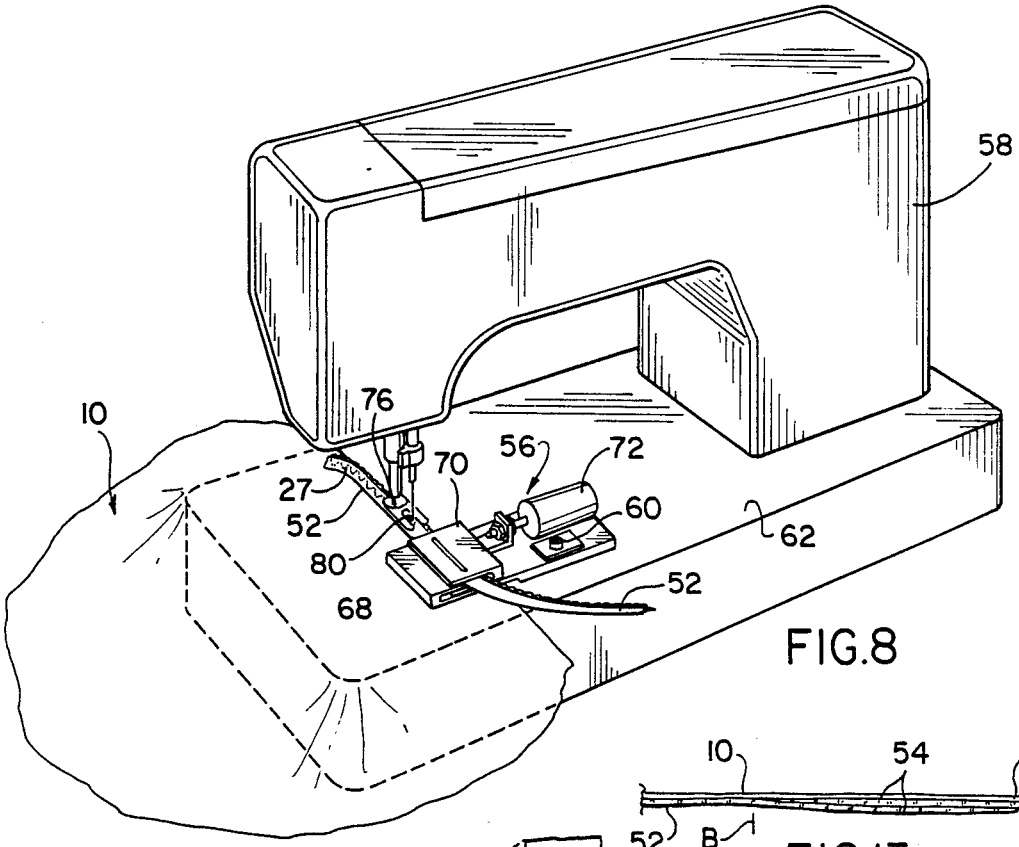
FIG. 8 is a perspective view of a conventional sewing machine on which the sewing method of present invention is applied in the sewing of a panty similar to that of FIGS. 2 and 5.
Figure 9:
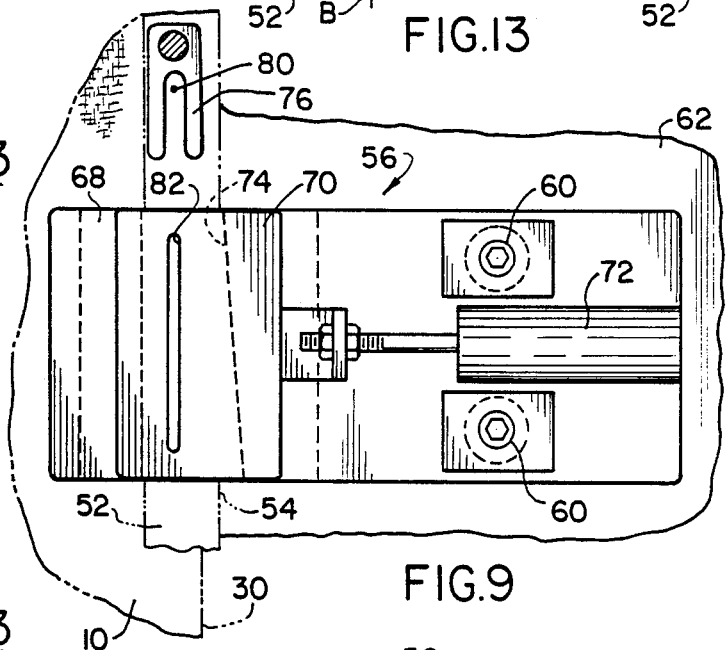
FIG. 9 is a plan view of an attachment used in conjunction with the sewing machine.
Figure 10:
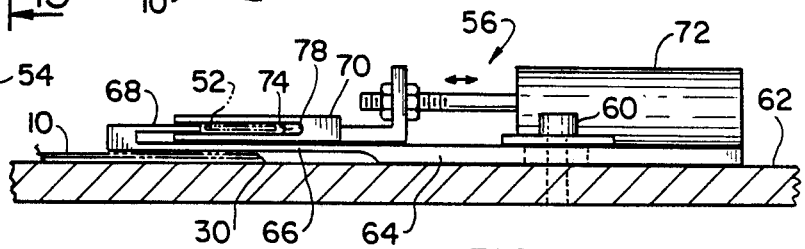
FIG. 10 is a front elevation of the attachment as projected from FIG. 9.

As illustrated in FIGS. 8, 9, and 10, slide 70 is in its position of movement to the extreme right for allowing the tape 52 with picot 54 to lie flat and feed towards the stitching position 80. Slot 82 in the upper surface of slide 70 allows for the operator to feed the lead end of tape 52 through slot 74 with the aid of a conventional hand pick (not shown). The pick is also used by the operator to place the lead end of tape 52 on the material or pattern 10 before the presser foot 76 is lowered, and stitching commenced.

As the operator sews in full circle fashion and passes point B, shown in FIGS. 11 and 12, the material or pattern 10 is manipulated by the seamstress so that tape 52 with picot 54 is stitched below the plane of waist opening 30. Simultaneously, the operator activates means 72 to move slide 70 to its extreme left position of movement. This action constricts the outlet of slot 74 causing the picot 54 in this constriction to yield and fold, whereupon it is caught and held by the zig-zag stitching 27.

The above described sewing technique will be understood to be applicable to a variety of tapes, laces, ribbons and trimmings that might be applied to many garments as well as to flatgoods, such as doilies, bed spreads, and the like.

Additionally, while the particular sewing method herein shown and disclosed in detail is fully capable of attaining the objects and providing the advantages hereinbefore stated, it is to be understood that it is merely illustrative of the presently preferred embodiment of the invention and that no limitations are intended to the detail thereof other than as defined in the appended claims.

What is claimed is:

1. A method of sewing a discreet elastic length having opposite leading and trailing ends about a garment waist opening comprising the steps of sewing cooperating sides of a pattern of said garment to form side seams for said garment effective to provide a closed upper garment edge bounding said waist opening, attaching by sewing the leading end of said elastic length at a selected location on said upper garment edge other than at the locations of said side seams and at a selected distance below said upper garment edge, continuing the attaching by sewing to said upper garment edge of a remaining elastic length except for a portion thereof which is at a selected distance short of the trailing end, shifting the unattached trailing end of said elastic length below said upper garment edge, and attaching by sewing the shifted said elastic trailing end, whereby the elastic leading which might contribute to an unsightly appearance are below said upper garment edge and the coinciding of the location of these ends with the location of the side seams which might contribute to bulk and discomfort is obviated.

2. The method of sewing an elastic length to a garment waist opening as claimed in claim 1 including arranging the shifted trailing end in crossing relation to said leading end prior to the sewing attachment thereof.

3. The method of sewing an elastic length to a garment waist opening as claimed in claim 2 including folding down an upper edge of said shifted trailing elastic end prior to the sewing attachment thereof.

* * * * *